United States Patent [19]

LeBegue et al.

[11] 4,316,635

[45] Feb. 23, 1982

[54] EXTENSIBLE AND RETRACIABLE ROTOR ARM CUTTING ASSEMBLY

[75] Inventors: Maurice K. LeBegue, Argillite, Ky.; Earl C. Michael, Hoyleton, Ill.

[73] Assignee: National Mine Service Company, Pittsburgh, Pa.

[21] Appl. No.: 153,099

[22] Filed: May 27, 1980

[51] Int. Cl.[3] ..... E21C 27/24; E21B 10/62

[52] U.S. Cl. ..... 299/80; 175/267

[58] Field of Search ..... 299/61, 80; 175/267-269

[56] References Cited

U.S. PATENT DOCUMENTS

| | | | |
|---|---|---|---|
| 2,801,094 | 7/1957 | Ball | 175/267 X |
| 2,836,407 | 5/1958 | Tracy et al. | 299/61 |
| 2,890,033 | 6/1959 | Silks | 299/61 |
| 2,937,859 | 5/1960 | Jackson | 299/80 |
| 2,998,964 | 9/1961 | Morlan | 299/80 |
| 3,278,237 | 10/1966 | Karlovsky et al. | 299/59 |
| 3,278,238 | 10/1966 | Karlovsky et al. | 299/59 |
| 3,294,450 | 12/1966 | Karlovsky | 299/18 |
| 3,309,143 | 3/1967 | Karlovsky et al. | 299/57 |
| 3,309,144 | 3/1967 | Karlovsky | 299/60 |
| 3,350,137 | 10/1967 | Karlovsky | 299/61 |
| 3,376,072 | 4/1968 | Karlovsky | 299/59 |

*Primary Examiner*—Ernest R. Purser

*Attorney, Agent, or Firm*—Stanley J. Price, Jr.; John M. Adams

[57] ABSTRACT

A rotor arm cutting assembly includes a plurality of cutter arm members extending radially outwardly from a hub portion which is adapted for nonrotatable connection to a drive shaft extending from the front of a mining machine. Each cutter arm member includes a front face for supporting cutter bits operable to dislodge solid material from a mine face upon rotation of the drive shaft. A slot extends longitudinally outwardly from the hub portion to the end of each cutter arm member on the front face. A cutter arm extension is positioned for longitudinal movement in the slot. Complimentary guide members and guide ways associated with the extension portion and the cutter arm member maintain the extension portion movable in a longitudinal direction in the slot. The extension portion is extended and retracted relative to the cutter arm member by operation of a fluid actuated cylinder positioned for convenient servicing within a recess in the back of the cutter arm member. The extension portion also supports cutter bits so that extension thereof from the end of the cutter arm member extends the effective cutting length of the cutter arm member.

8 Claims, 3 Drawing Figures

EXTENSIBLE AND RETRACIABLE ROTOR ARM CUTTING ASSEMBLY

BACKGROUND OF THE INVENTION

1. Field of the Invention

This invention relates to a rotor arm cutting assembly and more particularly to an extensible and retractable rotor arm for a boring-type mining machine.

2. Description of the Prior Art

In boring-type mining machines as illustrated in U.S. Pat. No. 2,890,033 a pair of rotor cutter arms are mounted on a pair of parallel positioned drive shafts that extend forwardly from a gear box at the front of a mining machine. Rotation of the drive shafts rotates the rotor cutter arms to cut a pair of parallel bores in a seam of coal or mineral material to dislodge the material from a mine face. A conveyor mounted on the mining machine conveys the dislodged material rearwardly from the mine face for subsequent conveyance of the material from the mine. Also associated with the rotor cutter arms are cutter bars also mounted on the gear box above and below the rotor cutter arms. The cutter bars include orbitally movable chains that dislodge the cusps depending from the mine roof and upstanding from the mine floor formed by the boring action of the rotor cutter arms.

U.S. Pat. No. 2,937,859 discloses a boring-type mining machine that includes a rotor cutter arm having a base member and a cutter carrier member. The cutter carrier member fits over the base member to telescope relative to the base member. A piston cylinder assembly positioned in the base member is secured at one end to the base member and at the opposite end to the cutter carrier member. Actuation of the piston cylinder assembly shifts the cutter carrier member on the base member from a retracted position to an extended position.

While it has been suggested by the prior art devices to extend and retract the end of a rotor cutter arm, the prior art devices limit the cutting element to the extensible portion of the rotor cutter arm. This limits the cutting action to the end of the rotor cutter arm. Furthermore, by enclosing the piston cylinder assembly within the rotor cutter arm substantial difficulty is encountered in obtaining access to the piston cylinder assembly for maintenance of the assembly or removing the assembly for replacement.

Therefore, there is need to provide for a boring-type mining machine, a rotor arm cutting assembly that is extensible by operation of an actuating device which is readily accessible for repair and replacement on the assembly. There is a further need to maintain an extension portion movable longitudinally on the rotor arm with cutting elements provided on both the fixed portion and the extension portion of the rotor arm.

SUMMARY OF THE INVENTION

In accordance with the present invention there is provided a rotor arm cutting assembly that includes a rotor having a hub portion with an axis of rotation and a plurality of cutter arm members extending radially outwardly from the hub portion. The cutter arm members each have a fixed length and are adapted to dislodge solid material along the entire length of the respective cutter arm member upon rotation of the cutter arm members about the axis of rotation. A cutter arm extension portion is supported for longitudinal movement on each of the cutter arm members to extend and retract the effective cutting length of each cutter arm member. Each of the cutter arm members has a longitudinally extending slot for telescopically receiving the cutter arm extension portion. Complimentary guide means associated with each of the cutter arm members and the cutter arm extension portion maintain longitudinal movement of the cutter arm extension portion in the slot of each cutter arm member. Actuating means is provided for extending and retracting the cutter arm extension portion. The actuating means is secured to and extends between the cutter arm extension portion and the respective cutter arm member so that upon operation of the actuating means the cutter arm extension portion is movable longitudinally in the slot to both extend and retract the cutter arm extension portion relative to the cutter arm member.

Each of the cutter arm members has a surface adapted to receive and support a plurality of cutting elements and an outer end portion. The slot extends through the surface and from the outer end portion substantially the length of each cutter arm member. The cutter arm extension portion is slidable in the slot to a preselected position between a first position extending a preselected distance beyond the cutter arm member end portion and a second position retracted within the cutter arm member end portion. The complimentary guide means includes a guide way extending substantially the length of one of the cutter arm extension portion and each cutter arm member. A guide member is also provided and extends substantially the length of the other of the cutter arm extension portion and each cutter arm member. The guide member is slidable in the guide way to thereby telescopically position the cutter arm extension portion on each of the cutter arm members.

Preferably, the guide members project outwardly from the cutter arm member on each side of the slot. The guide ways are then formed in opposite sides of the cutter arm extension portion. With this arrangement, the cutter arm extension portion is retained within the slot of the respective cutter arm member by sliding engagement of the guide ways on the guide members.

The cutter arm members each include a front face for supporting a plurality of cutting elements as well as a back face that is provided with an opening that extends through and communicates with the slot. The cutter arm extension portion has a front face complimentary with the respective cutter arm member front face. The cutter arm extension portion front face is also adapted to receive and support a plurality of cutting elements and form with the respective cutter arm member surface a continuous cutting surface for dislodging solid material.

The actuating means is positioned in the opening that extends through the back face of each cutter arm member to facilitate efficient access thereto from the back of the respective cutter arm member and away from the front face where the cutting elements are positioned.

The actuating means preferably includes a fluid actuated cylinder having a cylinder portion at one end and a piston rod extending from the cylinder at the other end. The cylinder portion of the piston rod is selectively connected to either the cutter arm member or the cutter arm extension portion so that upon actuation of the cylinder to extend the piston rod, the cutter arm extension portion extends outwardly from the respective cutter arm member to thereby provide an adjustment in the effective cutting length of the cutter arm member.

Accordingly the principle object of the present invention is to provide a rotary arm cutting assembly that includes a plurality of cutter arm members of a fixed length with an extension portion slidably mounted on each cutter arm member and telescopically moved by operation of a fluid actuated cylinder so that the effective cutting length of each cutter arm member is adjustable by extension of the extension portion.

Another object of the present invention is to provide for a boring-type mining machine a rotary arm cutting assembly that includes a plurality of cutter arm members each provided on one surface thereof with a longitudinally extending slot having a guide member on each side of the slot and arranged to engage a guide way of a rotor arm extension to permit and retain the rotor arm extension telescopically positioned on the respective cutter arm member where both the cutter arm member and the rotor arm extension are provided with a plurality of cutting elements and the effective cutting length of the rotor arm member can be increased by extension of the rotor arm extension from the end of the respective cutter arm member.

These and other objects of the present invention will be more completely disclosed and described in the following specification, the accompanying drawings, and the appended claims.

DESCRIPTION OF THE PREFERRED EMBODIMENT

Figure 1:
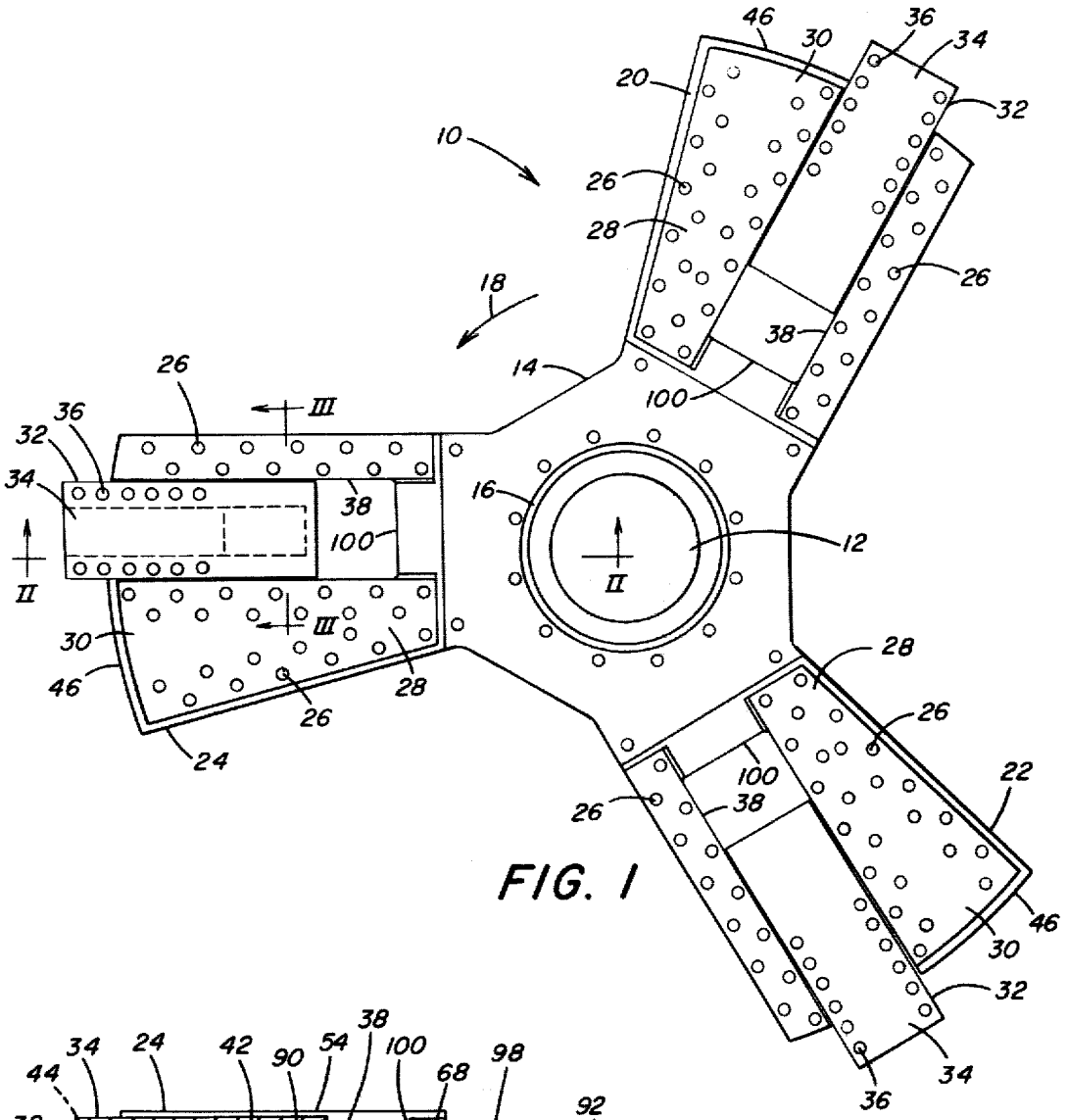
FIG. 1 is a front elevational view of a rotary arm cutting assembly, illustrating a plurality of cutter arm members extending from a hub portion and provided with extension portions by which the length of each cutter arm is extendable.

Referring to the drawings and particularly to FIG. 1 there is illustrated a rotary arm cutting assembly generally designated by the numeral 10 that is nonrotatably mounted on a drive shaft 12 that extends forwardly from the gear box associated with the boring head of a boring-type continuous mining machine (not shown). As well-known with conventional boring-type mining machines a pair of rotary arm cutting assemblies positioned on separate drive shafts in side by side relation are arranged to cut a pair of parallel bores in a seam of coal or mineral material. The scope of the present invention is confined to the structure of the rotary arm cutting assembly 10; therefore, it should be understood that the following description of the rotary arm cutting assembly is applicable to the arrangement where a pair of such assemblies would be mounted on a mining machine or where only a single assembly would be utilized on a mining machine.

The rotary arm cutting assembly 10 includes a rotor 14 having a hub 16 with an axis of rotation concentric with the axis of rotation of the drive shaft 12. The hub 16 is suitably nonrotatably connected to the drive shaft 12 so that upon rotation of the drive shaft, for example in the direction indicated by the arrow 18 the rotary arm cutting assembly 10 rotates in the direction of the arrow 18. The rotor also includes a plurality of cutter arm members 20, 22, and 24 that extend radially outwardly from the hub portion 16. Each of the cutter arms 20, 22, and 24 includes a plurality of holes 26 on a front face 28 of each arm member. The holes are adapted to receive the tool holders that are utilized to support cutter bits on the respective cutter arm member. The construction of the tool holders and the cutting bits and their manner of assembly on the respective cutter arms is conventional and therefore neither the tool holders nor the cutter bits are illustrated in FIG. 1 and will therefore not be herein described.

Upon rotation of the rotor 14 a bore is cut in the mine face in which the radius of the bore is determined by the effective cutting length of each cutter arm member 20, 22, and 24. Each of the cutter arm members has a first portion 30 of a fixed cutting length as determined by the length of the first portion 30 that receives the cutter bits. The overall effective length of each cutter arm 20, 22, and 24 is extensible by the provision of a second portion of each arm member or a cutter arm extension portion 32. The cutter arm extension portion 32 is supported for longitudinal movement on each of the cutter arm first portions 30 to extend and retract the effective overall cutting length of the cutter arm members 20, 22, and 24. Each of the cutter arm extension portions 32 includes a surface or front face 34 complimentary with the front face 28 of each cutter arm first portion 30. Each of the extension portion front faces 34 is provided with a plurality of holes 36 for receiving conventional tool holders to support cutter bits as described above for supporting cutter bits on the cutter arm members 20, 22, and 24. Thus, with this arrangement, the front faces 34 of the cutter arm extension portions 32 and the front faces 28 of the respective cutter arm members form a continuous surface extending outwardly from the hub 16 for dislodging solid material, for example, from a mine face.

Each of the cutter arm members 20, 22, and 24 has a longitudinally extending slot for telescopically receiving the respective cutter arm extension portion 32. Complimentary guide means generally designated by the numeral 38 in FIG. 3 are associated with each cutter arm member 20, 22, and 24 and the respective cutter arm extension portion 32 for maintaining longitudinal movement of the respective cutter arm extension portion 32 in the respective slot 38 of each cutter arm member 20, 22, and 24.

Figure 3:
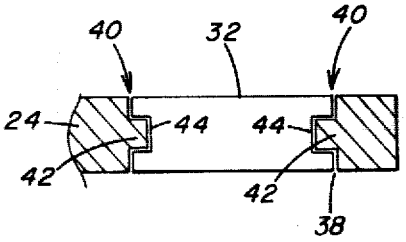
FIG. 3 is a fragmentary sectional view taken along line III—III of FIG. 1, illustrating the slidable engagement of a rotary arm extension portion on guide members projecting from the cutter arm member into guide ways of the extension portion.

In FIG. 3 the complimentary guide means 40 is illustrated for the combination cutter arm extension portion 32 and the cutter arm member 24; however, it should be understood that this arrangement is representative of the slidable arrangement of each of the other cutter arm extension portions 32 for the cutter arm members 20 and 22. Preferably the complimentary guide means 40 includes a pair of guide members 42 that project from the cutter arm member 24 into the slot 38. The guide members 42 are formed integral with the cutter arm member 28 and extend at least the length of the slot 38. The guide members 42 are arranged to extend into a corresponding pair of guide ways that are machined within the vertical surfaces as seen in FIG. 3 of the respective cutter arm extension portion 32. Preferably the guide ways 44 extend substantially the length of the cutter arm extension portion 32.

The cutter arm extension portion 32 is slidable in the slot 38 and is maintained in a preselected position by engagement of the guide members 42 with the guide ways 44 of the cutter arm extension portion 32. Preferably the cutter arm extension portion 32 is slidable relative to the respective cutter arm member 24 to a preselected position between a first position extending a preselected distance beyond the end 46 of the cutter arm member 24, as illustrated in FIG. 1, and a second position (not shown) retracted within the end portion 46 of the cutter arm member 24.

The telescoping movement of each of the cutter arm extension portions 32 relative to the respective cutter arm members 20, 22, and 24 is accomplished by operation of an actuating means generally designated by the numeral 50 in FIG. 1. The actuating means is operable to extend and retract the cutter arm portions 32 relative to the respective cutter arm members 20, 22, and 24. The actuating means 50 is secured to and extends between the respective cutter arm extension portions 32 and the respective cutter arm members 20, 22, and 24. Upon operation of the actuating means 50 the cutter arm extension portion 32 is movable longitudinally in the respective slot 38 to both extend and retract the cutter arm extension portion 32 relative to the respective cutter arm member.

Figure 2:
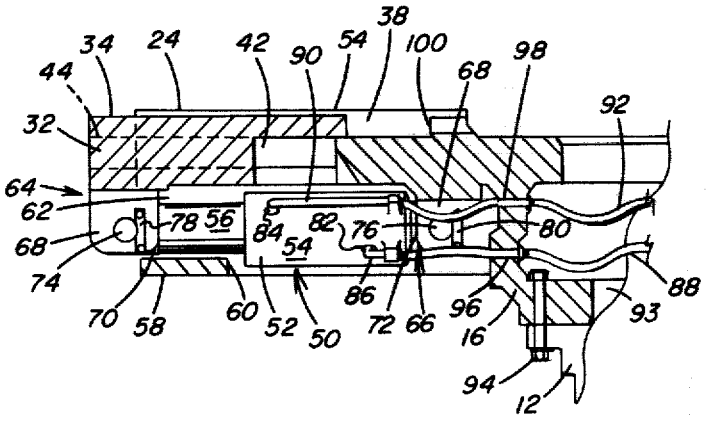
FIG. 2 is a fragmentary sectional view taken along the line II—II of FIG. 1, illustrating a rotary arm extension portion positioned for slidable movement in a slot of a respective cutter arm member with a fluid actuated piston cylinder connected to the cutter arm member and the extension portion for extending and retracting the extension portion on the cutter arm member.

As illustrated in greater detail in FIG. 2, the actuating means 50 includes a fluid actuated cylinder 52, operable either pneumatically or hydraulically, having a cylinder portion 54 at one end and a piston rod 56 extending from the cylinder 54 at the other end. Also as illustrated in FIG. 2, each of the cutter arm members 20, 22, and 24 has a back face 58 with an opening 60 therethrough into a recess 62 formed within the body of each cutter arm member 20, 22, and 24. The recess communicates with the slot 38 which is positioned above the recess 62. The fluid actuated cylinder 52 is positioned within the recess 62 to facilitate efficient access thereto from the back of the respective cutter arm member 20, 22, and 24 for repair or replacement of the cylinder 52.

The cutter arm extensible portion 32 as shown in FIG. 2 at the outermost end portion thereof includes a depending portion 64 that extends downwardly from the slot 38 into the recess 62. At the opposite end of the recess 62 the respective cutter arm member 24 includes a depending portion 66 that extends downwardly from the bottom surface of the cutter arm member 24 adjacent the slot 38 into the recess 62. The fluid actuated cylinder 52 is positioned between the depending portions 64 and 66 with the end of the piston rod 56 positioned adjacent the depending portion 64 and the cylinder 54 positioned adjacent the depending portion 66. Preferably each of the depending portions 64 and 66 are in the form of a conventional clevis-type connection that includes a pair of parallel spaced plates 68.

Only a single plate 68 of the pair of plates for the clevis connections 64 and 66 is shown in FIG. 2. The clevis connection 64 receives between the pair of plates 68 a mounting bracket 70 on the end portion of the piston rod 56. Similarly, the clevis connection 66 receives between the pair of plates 68 a mounting bracket 72 on the end portion of the cylinder 54. The brackets 70 and 72 and the pair of plates 68 of the clevis connections 64 and 66 have aligned bores for receiving pins 74 and 76 respectively. With this arrangement the piston rod 56 is connected to the cutter arm extension portion 32 and the cylinder 54 is connected to the respective cutter arm member 20, 22, and 24.

Once mounted in position within the recess 62 and connected to the cutter arm extension portion 32 and the respective cutter arm member 20, 22, and 24, the fluid actuated cylinder 52 is retained in place by engagement of a pair of lock bars 78 and 80 with the pins 74 and 76 respectively. Each pin 74 and 76 is provided with a peripheral groove on a portion of the respective pin 74 and 76 that extends from the plates 68. The lock bars 78 and 80 are securely fastened at their end portions to the plates 68 by conventional fasteners to facilitate removal of the lock bars 78 and 80 from connection to the plates 68. When secured to the plates 68, the lock bars 78 and 80 engage the pins 74 and 76 to prevent the pins 74 and 76 from passing freely through the aligned bores of the plates 68 and the mounting brackets 70 and 72.

In this manner the fluid actuated cylinder is securely connected to the cutter arm extension portion 32 and the respective cutter arm member 20, 22, and 24 and is thereby operable to be easily disconnected therefrom and removed from the recess 62 for maintenance of the fluid actuated cylinder 52. It also should be understood that the fluid actuated cylinder 52 can be positioned in the recess 62 in a manner where the extensible piston rod 56 is connected to the respective cutter arm member 20, 22, and 24 and the cylinder 54 is connected to the cutter arm extension portion 32.

The fluid actuated cylinder 52 is a double acting cylinder and is provided with a fluid extension port 82 and a fluid retraction port 84. The extension port 82 is positioned oppositely of the end of the piston (not shown) on the piston rod 56 within the cylinder 54. The retraction port 84 is positioned oppositely of the end of the piston rod 56. The extension port 82 is connected by a pipe fixture 86 to a flexible pressure line 88. The retraction port 84 is connected by a pipe fixture 90 to a flexible pressure line 92. Fluid under pressure is selectively supplied to the cylinder 54 from a hydraulic pump or air compressor (not shown) mounted on the mining machine through the pressure line 88 and the port 82.

Supplying fluid to the port 82 shifts the piston within the cylinder 54 and and extends the piston rod 56 from the cylinder 54. Extension of the piston rod 56 from the cylinder 54 extends the cutter arm extension portion 32 on the respective cutter arm member 20, 22, and 24. By controlling the amount of extension of the piston rod 56 by the volume of fluid supplied to the extension port 82, the amount of extension of the cutter arm extension portion 32 from the respective cutter arm member 20, 22, and 24 is controlled.

The cutter arm extension portion 32 is retracted by terminating fluid flow to the cylinder extension port 82 and supplying fluid under pressure through the pressure line 92 and the retraction port 84 into the cylinder 54. The fluid acts on the end of the piston adjacent the piston rod 56 to retract the piston rod 56 into the cylinder 54. Accordingly, the volume of fluid supplied to retraction port 84 controls the amount of retraction of the cutter arm extension portion 32 on the respective cutter arm member 20, 22, and 24.

Suitable valve controls, as known in the art, are utilized with the fluid source to provide selective positioning of the cutter arm extension portions 32 on the cutter arm members 20, 22, and 24 to a fully retracted position or further to a position intermediate the fully extended and retracted positions.

The fluid pressure lines 88 and 92 extend from a fluid source on the mining machine (not shown) through a center bore 93 of the drive shaft 12. As illustrated in FIG. 2, the drive shaft 12 is suitably connected by a plurality of bolts 94, one of which is shown in FIG. 2, to the hub 16 of the rotor 14 adjacent the back face 58 of the cutter arm members 20, 22, and 24. The pressure lines 88 and 92 extend from the center bore 93 of the drive shaft 12 and pass through bores 96 and 98 respectively in the housing of the hub 16. From the bores 96 and 98, the pressure lines 88 and 92 extend to the pipe fixtures 86 and 90 where they are connected in a manner to facilitate efficient removal of the fluid actuated cylinder 52 from the recess 62 for servicing.

As illustrated in FIGS. 1 and 2, the cutter arm extension portions 32 are in an extended position on the cutter arm members 20, 22, and 24. The cutter arm extension portions 32 can be further extended from this position by further extension of the piston rods 56 from the cylinders 54 or retracted from this position by retraction of the piston rods 56 into the cylinders 54.

Each of the cutter arm members 20, 22, and 24 also includes a stop or abutment member 100 positioned at the closed end of the respective slot 38. The opposite end of the slot 38 is open to permit the movement of the cutter arm extension portion 32 away from or toward the respective cutter arm member 20, 22, and 24. Thus when the extension portion 32 is fully retracted in the slot 38, the inner end of the extension portion 32 adjacent the hub 16 abuts the stop 100. In this manner each of the cutter arm extension portions can be moved to a corresponding retracted position on the respective cutter arm member 20, 22, and 24.

It also should be understood in accordance with the present invention that the longitudinal movement of each cutter arm extension portion 32 in each slot 38 is controllable by providing the extension portion 32 with outwardly projecting guide members 42, as opposed to the arrangement in FIG. 3 where the guide members 42 are shown projecting from the respective cutter arm member into the slot 38. With this alternative arrangement the guide ways 44 are machined into the opposite surfaces of the respective cutter arm member. The guide members 42 on the extension portion 32 are thus slidably retained in the guide ways 44 of the cutter arm member to maintain longitudinal movement of the extension portion 32 in the slot 38 upon extension and retraction of the fluid actuated cylinder 52.

According to the provisions of the Patent Statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A rotor arm cutting assembly comprising, a rotor having a hub portion with an axis of rotation and a plurality of cutter arm members extending radially outwardly from said hub portion, said cutter arm members each having a fixed length and adapted to dislodge solid material along the entire length of said respective cutter arm member about said axis of rotation, a cutter arm extension portion positioned for longitudinal movement on each of said cutter arm members to extend and retract the effective cutting length of each cutter arm member, each of said cutter arm members having a longitudinally extending slot for telescopically receiving said cutter arm extension portion, complimentary guide means associated with each cutter arm member and said cutter arm extension portion for maintaining longitudinal movement of said cutter arm extension portion in said slot of each cutter arm member, actuating means for extending and retracting said cutter arm extension portion, a recess formed in one side of each of said cutter arm members, said recess being positioned oppositely of said slot and extending longitudinally relative to said slot, means secured to said respective cutter arm member and extending downwardly through said slot into said recess for mounting said actuating means to said cutter arm member, said actuating means being connected to said mounting means to support said actuating means within said recess and oppositely of said slot, an opening extending through said cutter arm member and communicating with said recess to permit access to said actuating means within said cutter arm member, and said actuating means being secured to and extending between said cutter arm extension portion and said respective cutter arm member so that upon operation of said actuating means said cutter arm extension portion is movable longitudinally in said slot to both extend and retract said cutter arm extension portion relative to said cutter arm member.

2. A rotor arm cutting assembly as set forth in claim 1 in which, each of said cutter arm members has a surface adapted to receive and support a plurality of cutting elements and an outer end portion, said slot extending through said surface and from said outer end portion substantially the length of each cutter arm member, and said cutter arm extension portion being slidable in said slot to a preselected position between a first position extending a preselected distance beyond said cutter arm member end portion and a second position retracted within said cutter arm member end portion.

3. A rotor arm cutting assembly as set forth in claim 2 in which, said cutter arm extension portion includes a surface complimentary with said surface of each cutter arm member, and said cutter arm extension portion surface being adapted to receive and support a plurality of cutting elements and form with said cutter arm member surface a continuous cutting surface for dislodging solid material.

4. A rotor arm cutting assembly as set forth in claim 1 in which, said complimentary guide means includes a guide way extending substantially the length of one of said cutter arm extension portion and said each cutter arm member.

a guide member extending substantially the length of the other of said cutter arm extension portion and said each cutter arm member, and said guide member being slidable in said guide way to thereby telescopically position said cutter arm extension portion on each of said cutter arm members.

5. A rotor arm cutting assembly as set forth in claim 1 in which, said actuating means includes a fluid actuated cylinder having a cylinder portion at one end and a piston rod extending from the cylinder at the other end, said recess extending downwardly from said slot, said fluid actuated cylinder being positioned within said recess, said cutter arm extension portion and each of said cutter arm members having depending portions connected to opposite ends of said fluid actuated cylinder, and said piston rod being operable upon actuation of said fluid actuated cylinder to extend and retract relative to said cylinder portion to extend and retract said cutter arm extension portion relative to each of said cutter arm members.

6. A rotor arm cutting assembly as set forth in claim 1 in which, said cutter arm members each include a front face for supporting a plurality of cutting elements, said cutter arm members each including a back face with said opening extending therethrough and communicating with said slot, and said actuating means being positioned in said opening to facilitate efficient access thereto from said back face.

7. A rotor arm cutting assembly as set forth in claim 1 in which, said slot includes an open end portion through which said cutter arm extension portion is movable, said slot including a closed end portion positioned adjacent said hub portion, and said slot closed end portion forming a stop to receive and position the end of said cutter arm extension portion in a fully retracted position.

8. A rotor arm cutting assembly as set forth in claim 1 in which, said mounting means includes a clevis connection extending downwardly from said cutter arm extension portion and each of said cutter arm members, each of said clevis connections adapted to receive said actuating means, pin members extending through said clevis connections and said actuating means to connect said clevis connections to said actuating means, and locking means removably attached to said actuating means and engaging said pin members in position to connect said clevis connections to said actuating means.

* * * * *